US005383408A

United States Patent [19]

Searcy

[11] Patent Number: 5,383,408

[45] Date of Patent: Jan. 24, 1995

[54] PROTECTIVE SLIP PALLET AND METHOD

[76] Inventor: Ronald S. Searcy, 2893 W. 132nd Ave., Thornton, Colo. 80241

[21] Appl. No.: 775,207

[22] Filed: Oct. 11, 1991

[51] Int. Cl.[6] ..... B65D 19/00

[52] U.S. Cl. ..... 108/51.1

[58] Field of Search ..... 108/51.1, 53.1, 53.3, 108/53.5, 27; 240/346; 206/386

[56] References Cited

U.S. PATENT DOCUMENTS

| | | | |
|---|---|---|---|
| Re. 29,192 | 4/1977 | Anderson | 108/51.1 |
| 2,913,206 | 11/1959 | Paris | 108/51.1 X |
| 3,776,145 | 12/1973 | Anderson . | |
| 3,814,489 | 6/1974 | Clark et al. | 108/53.1 X |
| 3,853,073 | 12/1974 | Flum et al. | 108/53.1 X |
| 4,042,127 | 8/1977 | Brossia . | |
| 4,467,004 | 8/1984 | Ziebel . | |
| 4,507,348 | 3/1985 | Nagata | 108/51.1 X |
| 4,570,546 | 2/1886 | Batelka . | |
| 4,649,007 | 3/1987 | Bonis | 108/51.1 X |
| 4,735,153 | 4/1988 | Wong | 108/51.1 |
| 4,906,510 | 3/1990 | Todor | 108/51.1 X |
| 5,062,370 | 11/1991 | Etlinger | 108/51.1 X |

FOREIGN PATENT DOCUMENTS

| | | | |
|---|---|---|---|
| 0138167 | 12/1978 | Japan | 108/53.5 |

*Primary Examiner*—Jose V. Chen

*Attorney, Agent, or Firm*—Fields, Lewis, Rost & Smith

[57] ABSTRACT

A slip pallet system for protecting the sides of palletized box loads is disclosed. The slip pallet system includes two sheets of tough pliable material which are arranged back-to-back and positioned between two box loads so that the upper surface of one sheet is in contact with the bottom of the upper box load while the upper surface of the second sheet is in contact with the top surface of the lower box load. Each sheet also includes at least one protective tab for folding along an edge of the sheet to protect a side of a box load from being punctured. At least one tab of each sheet has a tab folding member which extends from the underside surfaces of the tab. The folding members are designed to cooperate with each other when the sheets are arranged back-to-back so that the tabs from which the folding members extend pivot in opposite directions to fold the tabs against the sides of the upper and lower box loads, thereby protecting the box load sides.

15 Claims, 2 Drawing Sheets

PROTECTIVE SLIP PALLET AND METHOD

TECHNICAL FIELD

The invention relates generally to pallets, and more particularly to an improved slip pallet system which protects the sides of merchandise, generally boxes, palletized by the system.

BACKGROUND OF THE INVENTION

Cereal, canned goods, bottled goods, beer and the like are ordinarily packaged in cardboard boxes which are usually sized so that a man can easily handle a single box. Over the years, however, such manual handling of single boxes has given way to machine handling of large numbers of boxes wherein the boxes are stacked on pallets and moved with forklift trucks. A common type of pallet includes a flat-board surface, usually wooden, supported upon short, spaced rails. This pallet is typically about four inches thick. In use, the forks of a forklift truck move into the pallet underneath the flat surface between the rails to lift the pallet and stack merchandise upon it.

A more sophisticated development in this art involves the use of a slip pallet which typically is made from a ⅛" thick plastic sheet such as the plastic slip pallet described in U.S. Pat. No. Re. 29,192 to Anderson et al, which is hereby incorporated by reference. In use, the slip pallet is placed upon a flat surface to support a number of boxes which are stacked on the pallet. Slip pallets are preferable to regular pallets in many installations because they are much cheaper and thinner. The space savings possible with thin pallets is significant in many warehouses.

Slip pallets require a special type of lifting surface. The forks of a forklift truck cannot be used. Instead, a flat, spatula-like member, commonly called a platen, is mounted upon a lift truck. To pick up a load of stacked boxes, the platen is elevated so that its extended leading edge is beneath the slip pallet. The platen is then pushed underneath the slip pallet to engage and pick up the slip pallet and its load. The load is then moved to its new location where the load and slip pallet are then pushed off the platen.

While the aforementioned slip pallets satisfactorily palletize merchandise, they do little to protect the sides of boxes stacked on the pallets. For example, if the box load comprises cereal boxes or similar thin walled containers or packages, the exposed sides of the boxes are very vulnerable to being punctured if they are contacted by a platen or the gripper of a platen-type lift truck. While accurate estimates as to the amount of damage caused by such punctures have not been made, it is estimated that such damage costs businesses millions of dollars every year. Accordingly, a need clearly exists for a slip pallet system which will protect the sides of box loads from being easily damaged.

DISCLOSURE OF THE INVENTION

The present invention addresses the aforementioned concerns by providing a slip pallet and method of palletizing which protects the sides of palletized box loads. The slip pallet includes a sheet of material having an upper surface for contacting a box load stacked on the sheet. The sheet also has an underside surface and additionally includes protective tab means for folding along at least one edge of the sheet to protect a side of the box load from being punctured Each tab means or tab has an upper surface facing a side of the box load and an underside surface facing away from the box load side when it is folded up against the box load's side. In addition, the slip pallet includes tab folding means extending from the underside surface of at least one of the tabs for folding the tab upwardly against a side of the box load. The folding of the tabs will generally take place when the sheet is placed on a flat surface with the sheet's underside surface in contact with the flat surface. The sheet or pallet could also be designed so the tabs do not fold completely upwardly until one begins to stack boxes on the pallet, the weight of which would cause the tabs to fold upwardly against the sides of the box load.

The present invention also provides a slip pallet system using two pallets as described above. The pallets or sheets are arranged back to back with respect to each other so that the underside surface of the first pallet will be against and in contact with the underside surface of the second pallet. When the back to back arranged pallets are positioned between box loads, the upper surface of the first pallet will be in contact with the bottom surface of the upper box load while the upper surface of the second pallet is in contact with the top surface of the lower box load. Each pallet also includes protective tabs or tab means as described above for folding along at least one edge of the pallet to protect a side of a box load from being punctured.

The pallet system also includes tab folding means as described above which extend from the underside surfaces of the tabs of the sheets. The folding means cooperate with each other so that the tabs from which they extend pivot in opposite directions to fold against the sides of the upper and lower box loads, thereby protecting the sides. The folding means foldingly cooperate as described when the sheets are arranged back to back with respect to each other with the tab folding means of the sheets vertically aligned and in contact with each other.

In a preferred embodiment of the invention, each folding means has a right angled triangularly shaped base portion extending from the underside surface of the tab from which the folding means extends. The right angled edge of the base portion is located on the tab's underside surface near the edge of the sheet along which the tab folds. Each folding means is also oriented so that the hypotenuse side of the right angled base portion faces outwardly away from the edge of the sheet about which the tab folds. Each folding means also preferably includes an outwardly extending gripping portion which extends outwardly from the outer edge of the base portion and which can be gripped by the gripper of a platen-type lift truck.

The present invention also provides a method for protecting a box load. The method includes providing a slip pallet as discussed above. The slip pallet is then placed on a flat surface so that the slip pallet's underside surface faces and is in contact with the flat surface. A load of boxes is then stacked on the upper surface of the sheet of the slip pallet, the stacking of which insures upward folding of the slip pallet's tabs against the sides of the box load to protect the box load's sides. The upwardly folded tab means are then secured against the sides of the box load to prevent the tabs from folding downwardly during handling of the pallet and its load. In a preferred embodiment, the tabs are secured to the box load's sides by shrink-wrapping a plastic-like material around the upwardly folded tabs and the sides of the box load.

BRIEF DESCRIPTION OF THE DRAWINGS

The invention will be more readily understood by reference to the accompanying drawings wherein like reference numerals indicate like elements throughout the figures and in which.

DETAILED DESCRIPTION OF THE DRAWINGS

Figure 1:
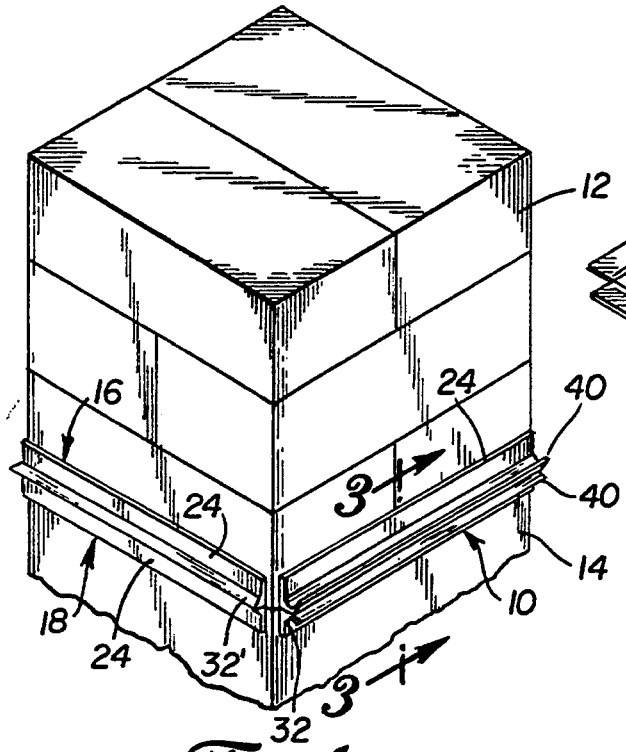
FIG. 1 is a perspective view of a slip pallet system of the present invention palletizing two box loads.
Figure 2:
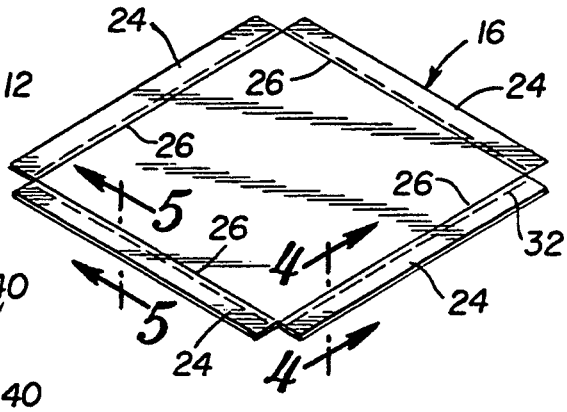
FIG. 2 is a perspective view of the upper sheet of the slip pallet system illustrated in FIG. 1.
Figure 3:
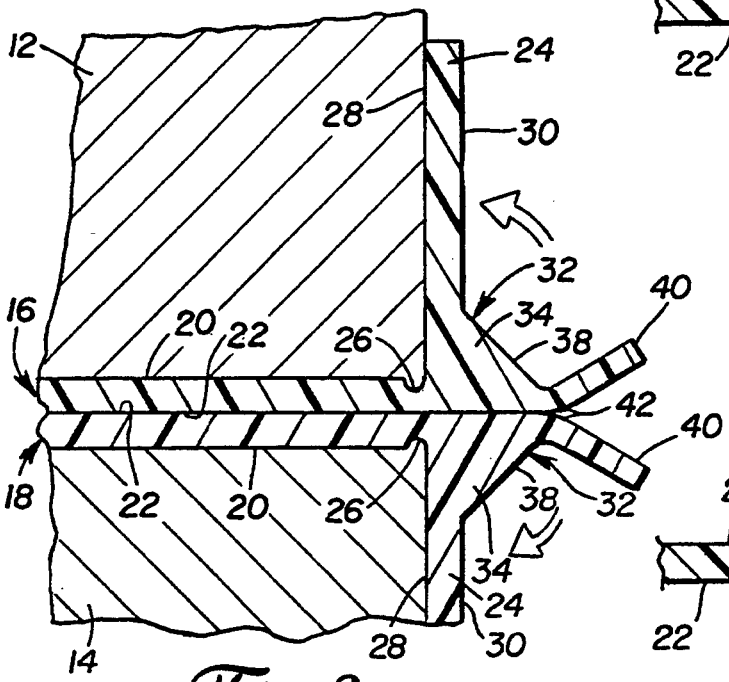
FIG. 3 is cross-sectional view taken along lines 3—3 of FIG. 1.

FIGS. 1 through 5 illustrate a preferred embodiment of a slip pallet system 10 of the present invention for palletizing box loads. FIGS. 1 and 3 illustrate system 10 palletizing a first box load 12 stacked on a second box load 14. In FIG. 3, it can be seen that system 10 comprises two back-to-back arranged sheets or pallets which are identified as first or upper sheet 16 and second or lower sheet 18. The sheets are made out of a tough, pliable, preferrably plastic, material such as that illustrated in U.S. Pat. No. RE 29,1922 to Anderson, et al. Each sheet has an upper surface 20 for contacting a box load and an underside surface 22 for contacting the underside surface of the other sheet when the sheets are arranged back-to-back as illustrated in FIGS. 1 and 3. As illustrated, the upper surface 20 of sheet 16 is in contact with the bottom (not numbered) of box load 12. Similarly, (but inverted) the upper surface 20 of second sheet 18 is in contact with the top surface (not numbered) of the second box load 14.

Figure 4:
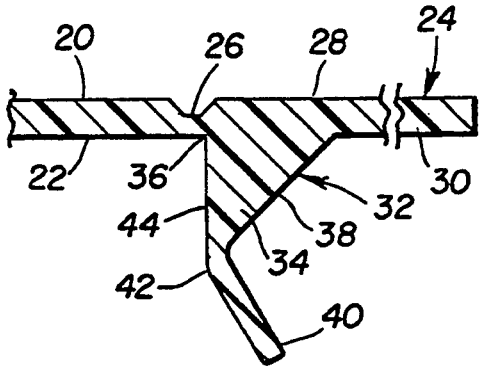
FIG. 4 is a cross-sectional view taken along lines 4—4 of FIG. 2.
Figure 5:
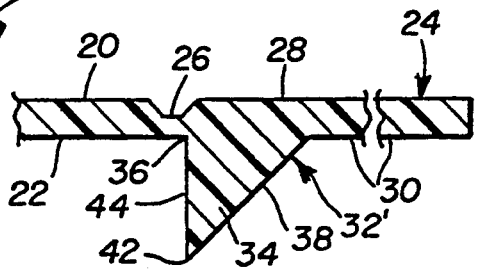
FIG. 5 is a cross-sectional view taken along lines 5—5 of FIG. 2.

FIGS. 1 and 3 also illustrate that each sheet 16 and 18 is provided with a protective tab means 24 which folds against the side of the box load to protect the boxes from being easily punctured e.g. by the gripper mechanism of a fork lift or a platen. As best illustrated in FIG. 3, the protective tabs fold along the edges of the sheets by pivoting along an indentation 26 provided in each sheet which extends along the edge of the sheet as illustrated in FIG. 2. FIG. 3–5 provide an enlarged cross-sectional view of several indentations 26 provided along the edges of sheets 16, 18.

As also illustrated in FIGS. 3–5, each protective tab has an upper surface 28 and an underside surface 30. Upper 28 surface faces and preferably contacts the side of the box load when the tab is folded against the box load. In contrast, underside surface 30 faces away or outwardly from the box load when the protective tab is folded against it.

FIG. 3 also illustrates that each sheet 16, 18 is provided with tab folding means 32 and 32'. The folding means cooperate with each other when the sheets are arranged back-to-back as illustrated in FIG. 3 to pivot the protective tabs (i.e. the tabs from which the folding means extend) in opposite directions so that they fold against the sides of the first and second box loads as illustrated in FIG. 3. Each folding means as best illustrated in FIG. 3 extends from the underside surface of a protective tab and is preferably integral therewith as illustrated. Each folding means also extends longitudinally along the underside surface of the tab from which it extends, each of which also extend longitudinally along an edge of a sheet.

The Figures also illustrate, particularly FIGS. 3 through 5, that each tab-folding means 32, 32' has a base portion 34 which in cross section has the shape of an right angled triangle. The right-angled edge identified by numeral 36 of the base portion is located, as illustrated, on the underside surface of the protective tab adjacent indentation 26 of the sheet along which the protective tab folds. Each folding means 32, 32' is also oriented so that the hypotenuse side 38 of the base portion faces outwardly away from the edge or indentation 26 about which the protective tab folds.

FIGS. 1, 3 and 4 illustrate that folding means 32 is provided with an outwardly extending gripping portion 40 which extends outwardly-from the outwardly projecting edge 42 of the base portion 34. Edge 42 as best illustrated in FIG. 4 is located at the intersection of hypotenuse side 38 and the other exposed side 44 of the base portion. Gripping portions 40 also preferably extend longitudinally along the edges of the sheet as illustrated in FIG. 1. The gripping portions 40 provide a surface or projection which can be gripped by the gripping mechanism of a fork lift or platen such as gripper 30 illustrated in U.S. patent application Ser. No. Re. 29,192 to Anderson, et al. for pushing and pulling of the pallet and its box load. Gripping of gripping portion 40 is facilitated by angling gripping portion 40 with respect to the plane of the protective tab so that the angle measured between the planes extending through the protective tabs and the gripping portion is between about 60 and 80 degrees, as illustrated.

In view of the above, it will be appreciated that the present invention provides a unique slip pallet system which not only palletizes stacked box loads, but also protects the sides of the box loads from being easily punctured or damaged. It is anticipated that use of the pallet system of the present invention could prevent millions of dollars of damage each year if the system is widely adopted by industry. As previously mentioned, the damage is typically caused by the grippers of fork lifts or platens which often puncture the sides of palletized boxes during positioning of the gripper to grip the tabs of conventional slip pallets.

It is not necessary to provide all tab folding means with a gripping portion 40 in accordance with the present invention. While a gripping portion 40 facilitates gripping of the slip pallets, it is not necessary for folding of the tabs. FIG. 1 shows that the tab folding means 32' located on the left side of the box loads depicted in the figure are not provided with gripping portions 40. However, folding means 32' as with folding means 32 are provided with a right angled triangularly shaped base portion which facilitates folding of the tab members against the sides of the box loads as described above. In view thereof, it will be appreciated that gripping portion 40 is not an essential part of the present invention. However, it is preferable to provide at least one of the tab folding means with a gripping portion 40 so that each sheet can be easily gripped by the gripper of a fork lift or platen. As illustrated in FIG. 1, folding means 32 depicted on the right side of the box loads are provided with gripping portions 40.

Figure 6:
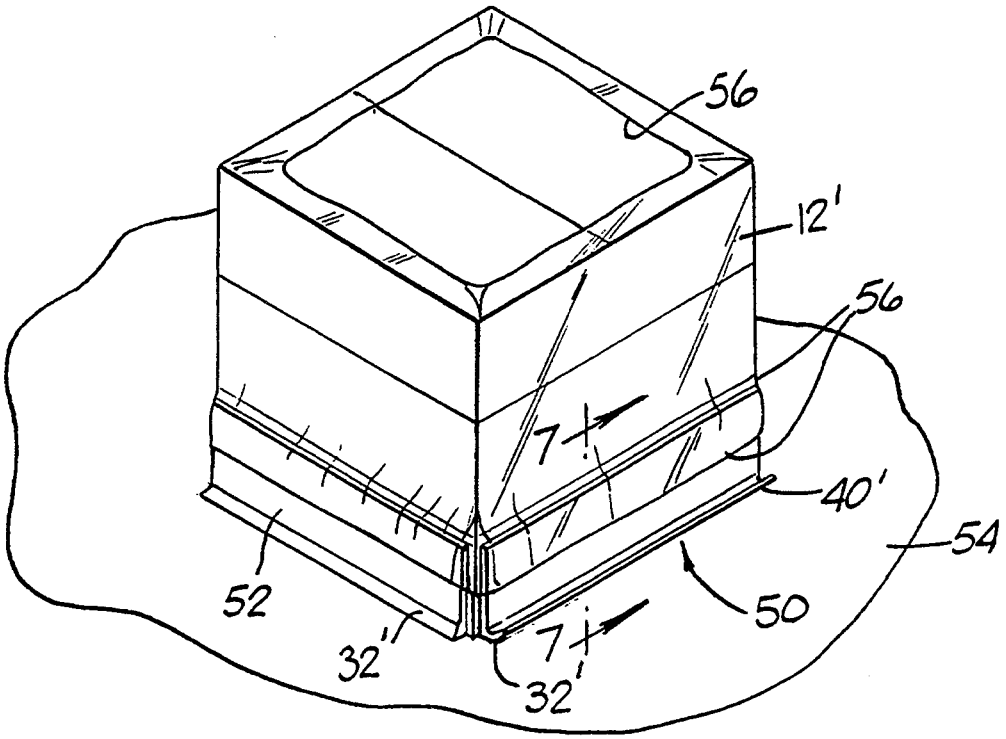
FIG. 6 is a perspective view of a single slip pallet embodiment of the present invention.
Figure 7:
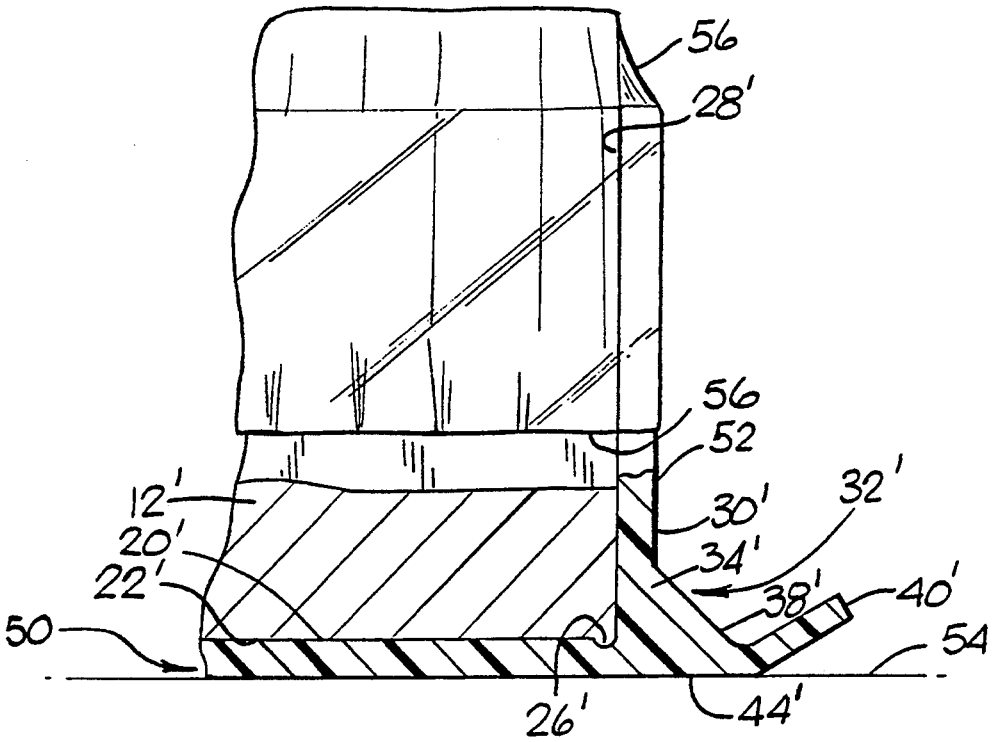
FIG. 7 is a cross-sectional view taken along lines 7—7 of FIG. 6.

FIGS. 6 and 7 illustrate a slip pallet 50 of the present invention which is identical to pallets 16 and 18 of system 10 with the exception that this embodiment's tabs 52 are approximately twice as long as protective tab means 24 of the first embodiment. (The elements of this embodiment which are identical to those of the first embodiment i.e. FIGS. 1 through 5 are numbered the same with the exception that the numbers are primed).

This embodiment of the present invention demonstrates that the invention does not require the use of two back-to-back arranged slip pallets, but will work as well on a flat surface 54. As illustrated in FIGS. 6 and 7, when slip pallet 50 is located on a flat surface 54 with the pallet's underside surface 22' located against surface 54, tab folding means 32' causes tabs 52 to fold upwardly. If the tabs of the pallet do not fold completely upwardly when the pallet is placed on a flat surface, the loading of a few boxes on the upper surface of the pallet will increase the pallet's weight sufficiently to cause complete i.e. vertical folding of the tabs. The pivoting or folding action provided by tab folding means 32' is identical to that of the first embodiment with the exception that the folding means cooperates with a flat surface 54 rather than the tab folding means of the other pallet.

This embodiment also illustrates that tabs 52 of the slip pallet can be secured or held upwardly against the side of the box load by securing the tabs to the box load. Tabs 52 can simply be taped to the sides of the box load or, as illustrated, the tabs may be shrink-wrapped to the sides of the box load by shrink-wrapping a sheet of plastic material 56 around the upwardly folded tabs 52 and box load 12'. Once the tabs are secured, it will be appreciated that the pallet and its box load can be moved or handled by a platen-type lift truck having a gripper which can pull the pallet and its box load by gripping portions 40', as such is described in the first embodiment.

Both illustrated embodiments of the present invention are provided with protective tabs along all edges, but there may be applications where a protective tab is only needed along one edge. Accordingly, it will be understood that such a pallet is considered to be within the scope of the present invention.

While the above invention has been shown and described in detail, it will be understood that the invention is not to be limited to the exact form disclosed and changes in detail and construction of the invention may be made without departing from the spirit thereof.

What is claimed is:

1. A protective slip pallet for supporting a box load comprising:

a sheet of material having an upper surface for contacting a box load stacked on said sheet, said sheet also having an underside surface, said sheet also including at least one protective tab means for folding along an edge of said sheet to protect a side of the box load from being damaged, each tab means having an upper surface for facing a box load side and an underside surface for facing away from the box load side when said tab means is folded up against the box load side; and tab folding means extending from said underside surface of at least one of said tab means for folding said tab means upwardly against a box load side to protect the box load.

2. A slip pallet as claimed in claim 1 wherein said tab means fold along indentations provided in said sheet along the edges thereof.

3. A slip pallet as claimed in claim 1 wherein said tab folding means are integral with said tab means.

4. A slip pallet as claimed in claim 1 wherein said tab means extend longitudinally along the edges of said sheets.

5. A slip pallet as claimed in claim 4 wherein said tab folding means of said longitudinally extending tab means also extend longitudinally along said edges of said sheet.

6. A slip pallet as claimed in claim 1 wherein said tab folding means has a right angled triangularly shaped base portion in cross section and wherein the right angled edge thereof is located on said underside surface of said tab means adjacent said edge of said sheet about which said tab means folds, said tab folding means also being oriented so that the hypotenuse side of said base portion faces outwardly away from said edge about which said tab means folds;

said tab folding means further including an outwardly extending gripping portion which extends outwardly from the outwardly projecting edge of said base portion, said outwardly projecting edge being defined by the hypotenuse side and the other exposed side of said base portion.

7. A slip pallet as claimed in claim 6 wherein said right angled triangularly shaped base portions and said outwardly extending gripping portions of said tab folding means extend longitudinally along said edges of said sheets.

8. A slip pallet as claimed in claim 7 wherein said outwardly extending gripping portion has a generally thin rectangularly shaped cross-section which extends outwardly from said right angled triangularly shaped base portion at an angle which is less than 90 degrees as measured between intersecting planes extending through said gripping portion and said tab means from which said tab folding means extends.

9. A slip pallet as claimed in claim 8 wherein said gripping portion of said tab folding means extends at an angle of between about 60 degrees and 80 degrees as measured between the planes extending through said tab means and said gripping portion.

10. A slip pallet as claimed in claim 1 wherein each edge of each sheet is provided with said tab means.

11. A slip pallet as claimed in claim 1 wherein at least two edges of said sheet includes said tab means and wherein at least one of said tab means includes said tab folding means.

12. A slip pallet as claimed in claim 11 wherein said sheet includes first and second tab means, said first tab means including tab folding means consisting of a right angled triangularly shaped base portion, said second tab means including tab folding means having a right angled triangularly shaped base portion and an outwardly projecting gripping portion, said gripping portion extending outwardly from the outwardly extending edge of said base portion.

13. A protective slip pallet system for palletizing a first load of boxes and the like stacked on a second load of boxes and the like, said system comprising:

a first and second sheet of tough pliable material, each sheet having an upper surface for contacting one of the box loads and an underside surface for contacting the underside surface of the other sheet so that when said sheets are arranged back to back said underside surface of said first sheet is against and in contact with said underside surface of said second sheet and so that when said back to back arranged sheets are positioned between the stacked box loads said upper surface of said first sheet is in contact with the bottom surface of the first box load and said upper surface of the second sheet is in contact with the top surface of the second box load; each sheet also including protective tab means for folding along at least one edge of said sheet to protect an otherwise exposed side of one of the box loads from being punctured, said tab means having an upper surface facing the box load's side and an underside surface facing away from the box load's side when said tab means is folded against the box load's side; and first and second tab folding means extending respectively from said underside surfaces of said tab means of said first and second sheets, said first and second tab folding means cooperating with each other so that said tab means having said tab folding means pivot in opposite directions to fold against sides of the first and second box load such that when folded the upper surface of each tab means faces a box load side, thereby covering and protecting the side of the box load, the cooperation of said first and second tab folding means taking place when said first and second sheets are arranged back to back with respect to each other with said first and second tab folding means vertically aligned and in contact with each other.

14. Method of protecting a box load comprising:

providing a protective slip pallet including:

a sheet of material having an upper surface for contacting a box load stacked on the sheet, the sheet also having an underside surface, the sheet also including at least one protective tab means for folding along an edge of the sheet to protect a side of the box load from being damaged, each tab means having an upper surface for facing a box load's side and an underside surface for facing away from the box load's side when it is folded up against the box load's side; and tab folding means extending from the underside surface of at least one of the tab means for folding the tab means upwardly against a side of the box load to protect the box load;

providing a generally flat surface;

placing the slip pallet on the flat surface with the sheet's underside surface facing and in contact with the flat surface;

stacking a load of boxes on the upper surface of the sheet of the slip pallet, the stacking of which insures upward folding of the slip pallet's tab means against at least one side of the box load to protect the box load; and securing the upwardly folded tab means against the box load's sides so that the tab means will not fold downwardly during handling of the pallet and its box load.

15. A method as claimed in claim 14 wherein said tab means is secured to the box load's sides by shrink-wrapping a plastic-like material around the upwardly folded tab means and the sides of the box load.

* * * * *